United States Patent [19]

Petersen

[11] 4,409,576

[45] Oct. 11, 1983

[54] METHOD AND APPARATUS WHICH CHANGE MAGNETIC FORCES OF A LINEAR MOTOR

[75] Inventor: Christian C. Petersen, Westwood, Mass.

[73] Assignee: Polaroid Corporation, Cambridge, Mass.

[21] Appl. No.: 345,232

[22] Filed: Feb. 3, 1982

[51] Int. Cl.[3] ..... H01H 9/20; H01H 36/00

[52] U.S. Cl. ..... 335/170; 335/207; 335/306; 335/284

[58] Field of Search ..... 310/15; 335/170, 205, 335/206, 207, 306, 302, 284

[56] References Cited

U.S. PATENT DOCUMENTS

| | | | |
|---|---|---|---|
| 3,022,400 | 2/1962 | Von Ahlefeldt | 200/93 |
| 3,065,366 | 11/1962 | Speiser et al. | 310/15 |
| 3,129,347 | 4/1964 | Tognola | 310/15 |
| 3,202,886 | 8/1965 | Kramer | 317/171 |
| 3,310,762 | 3/1967 | Goetz | 335/170 |
| 3,495,147 | 2/1970 | Flora | 318/135 |
| 3,728,654 | 4/1973 | Tada | 335/235 |
| 3,860,300 | 1/1975 | Lyman | 308/10 |
| 3,867,675 | 2/1975 | Kitz et al. | 318/119 |
| 3,981,245 | 9/1976 | Buzzell et al. | 102/70.2 GA |
| 4,117,431 | 9/1978 | Eicher | 335/306 |
| 4,265,530 | 5/1981 | Petersen | 354/235 |

FOREIGN PATENT DOCUMENTS 817381 7/1959 United Kingdom .

*Primary Examiner*—Harold Broome

*Attorney, Agent, or Firm*—Leslie J. Payne

[57] ABSTRACT

A method of and apparatus for changing the magnetic forces generated by and between a pair of magnetic assemblies spaced apart along a given path, by selectively positioning these fields with respect to each other.

12 Claims, 4 Drawing Figures

METHOD AND APPARATUS WHICH CHANGE MAGNETIC FORCES OF A LINEAR MOTOR

BACKGROUND OF THE INVENTION

This invention relates broadly to a method of and apparatus for changing magnetic forces. More particularly, it relates to method and apparatus wherein the magnetic forces generated by and between a pair of magnetic assemblies spaced apart along a given path are changed.

Apparatus employing interacting magnetic fields for generating motive forces are well known. One rather conventional kind includes a bobbin about which is wound one or more field coils. Mounted within the bobbin is an armature which may be comprised of a core formed from a piece of soft iron, as shown in U.S. Pat. No. 3,728,654; or a plurality of permanent magnets, as shown in U.S. Pat. Nos. 3,022,400, 3,202,886 and 3,495,147; or a combination of a core and a permanent magnet. Application of current in one direction to the field coil generates a magnetic field which interacts with the armature to drive the latter in one direction. Reverse application of the current causes the armature to be driven in an opposite direction.

Another kind is disclosed in applicant's commonly-assigned U.S. Pat. No. 4,265,530. In this patent, shutter blades are driven by a motor having an armature including a pair of spaced apart permanent magnets having common poles facing each other which create a magnetic field that intersects a field coil. Energization of the field coil results in movement of the armature.

Still another known actuator includes a pair of spaced apart permanent magnets having poles facing each other by a predetermined distance. A core piece is movable between the poles in response to field coils either diminishing or increasing the field strengths of the facing poles.

SUMMARY OF THE INVENTION

In accordance with this invention, there is provided a magnetic apparatus comprising first and second means aligned in and spaced apart along a given direction. Each one is operable for establishing first and second magnetic fields having predetermined strengths with like poles facing each other along the given direction. The first means includes magnetically permeable material having a distal end face in facing relation to an opposed end face of the second means. This material has a given permeability and a relatively lower resistance to demagnetization than the first field and is short enough in length so that when the second means is in remote proximity to the material, the magnetic field of the first means is permitted to extend at least to the distal end face of the material. This material is of great enough length so that when the second means is in close proximity to the material, all of the magnetic field of the first means is permitted to substantially pass through side surfaces of the material, whereby as the distance along the given direction between the first and second means is varied, an attractive force exists between the second means and the material when the end face of the second means is within a given distance of the distal end of the material and a repulsive force exists when the end face of the second means is greater than the given distance.

In one embodiment of the apparatus, the second means is spaced from the distal end by the given distance so that substantially neither attractive nor repulsive forces exist.

An object of this invention relates to a method of changing magnetic forces comprising the step of establishing first and second magnetic fields having predetermined strengths with like poles facing each other in alignment and spaced apart along a given direction. Included in the method is the step of having magnetically permeable material associated with the first field. The material has a distal end face in facing relation to an opposed pole of the second field and a given permeability and has less resistance to demagnetization than the first field. This material is short enough in length so that when the second field is in remote proximity to the material the first magnetic field is permitted to extend at least to the distal end face of the material and the material is of great enough length so that when the second field is in close proximity to the material, substantially all of the magnetic field of the first field is permitted to pass through side surfaces of the material. Included in the method is the step of varying the distance along the given direction between the first and second fields so that an attractive force exists between the second field and the material when the end face of the second field is within a given distance of the distal end of the material, and a repulsive force exists when the end face of the second field is greater than said given distance.

In one embodiment of the method the repulsive or attractive forces are substantially eliminated when the second field is spaced from the distal end by the given distance. In another embodiment of the method the given distance can change in response to changing the length of the permeable material.

Among the other objects of the invention are the provision of a method of and an apparatus for changing the characteristics of magnetic forces generated by and between aligned and spaced apart first and second magnetic assemblies as a function of the spacing therebetween, the provision of a method and apparatus of the above kind in which magnetic attraction forces can be changed to repulsion forces as the spacing of the assemblies is varied relative to a preselected spaced apart distance, the provision of a method and apparatus of the above kind in which repulsion and attraction forces between the assemblies is substantially eliminated when spaced apart by the preselected distance, and the provision of a method and apparatus wherein the magnitude of the preselected distance can be changed as a function of the length of a core of permeable material associated and movable with one of the magnetic assemblies.

Other objects and further scope of applicability of the present invention will become apparent from the detailed description to follow when taken in conjunction with the accompanying drawings in which like parts are designated by like reference numerals.

DETAILED DESCRIPTION

Figure 1:
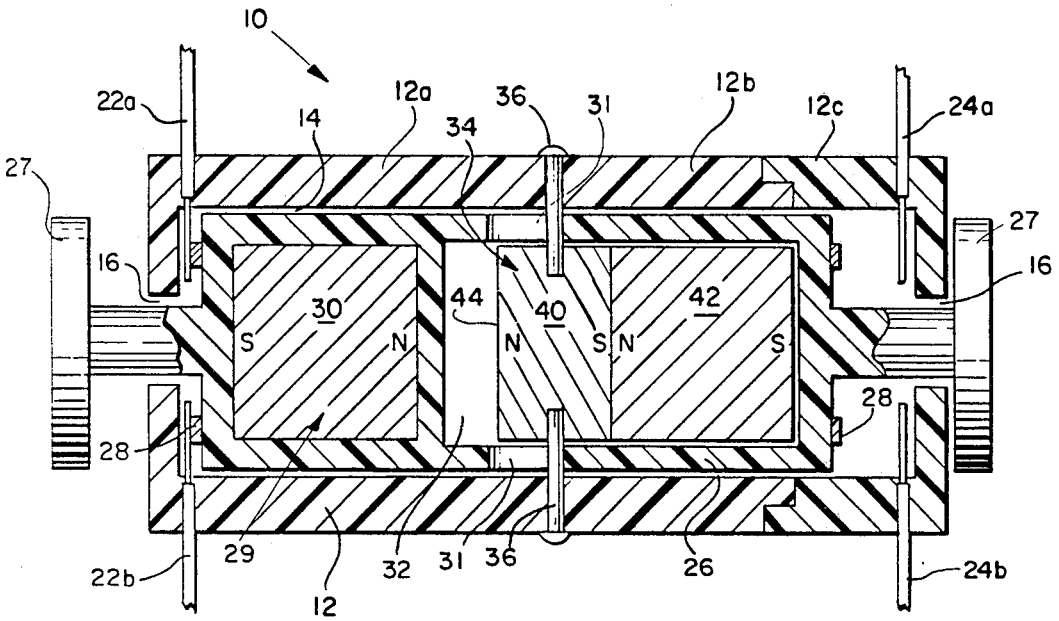
FIG. 1 is a cross-sectional view of a switch arrangement in one condition which embodies the principles of the present invention.
Figure 2:
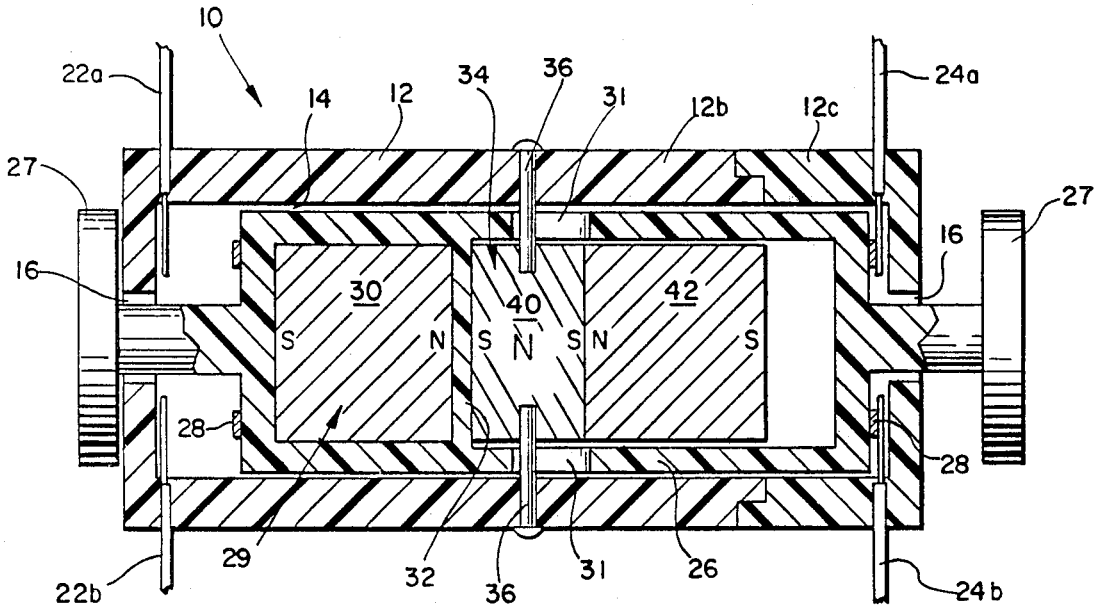
FIG. 2 is an elevational view, partly in section, showing the switch arrangement of FIG. 1, but in another condition.

FIGS. 1 and 2 show an over-center type switching mechanism 10 as one embodiment of the principles of the present invention. In this switching mechanism 10 provision is made for a tubular housing 12 comprised of interfitting and interconnected portions 12*a*, 12*b*, 12*c*, respectively. Formed in and by the housing 12 is an elongated cavity 14 and opposed longitudinal openings 16. Opposed pairs of electrical leads 22*a*, 22*b*; 24*a*, 24*b*; respectively, extend through suitable openings in the housing side wall. Of course, each of the pairs of leads 22*a*, 22*b*; 24*a*, 24*b* can be connected to circuitry not shown and not forming part of the present invention. These pairs of leads have terminal end portions, which are selectively electrically bridged in a manner to be described, and form parts of respective switches.

Disposed in the cavity 14 is a carrier member 26 having opposed manually operable push buttons 27. Each one of the buttons 27 extends through a respective one of the end openings 16. Connected to each interior opposite end wall of the carrier member 26 is a circular bus bar 28. As shown in FIG. 1, the left bus bar 28 serves to commonly connect the leads 22*a*, 22*b*, while the right bus bar 28 serves to commonly connect the leads 24*a*, 24*b* (FIG. 2). The bus bars 28 in conjunction with their respective leads provide for a pair of switches which are alternately operable in a manner to be described.

Both the housing 12 and the carrier 26 are made of a non-conducting material, such as Delrin, a thermoplastic resin sold by E. I. duPont de Nemours and Company of Wilmington, Delaware.

Carried in and by the carrier member 26 is a first magnetic assembly 29 comprising a permanent magnet 30, preferably, of the rare earth type like samarium cobalt. It is observed that the permanent magnet 30 has its north pole N end facing inwardly, while its south pole S end faces outwardly. Formed in the sidewall of the carrier 26 is a pair of diametrically opposed slots 31. A generally rectangular shaped recess 32 is formed in the carrier member 26 to permit its translational movement relative to the housing 12.

Disposed in the recess 32 is a second magnetic assembly 34. This second magnetic assembly 34 is secured to the housing 12 by a pair of pins 36 fixed in the housing. The pins 36 extend through the slots 31 of the slidable carrier member 26, which permit relative translational movement of the carrier member 26 with respect to the housing 12 and the second assembly.

Specifically referring to the second magnetic assembly 34, it essentially comprises a core member 40 and a permanent magnet 42. For instance, the core member 40 is made of a magnetically permeable material, such as 1005 Grade steel. The core member 40 has a distal end portion 44 spaced from and facing the end face (north pole N) of the permanent magnet 30. The permanent magnet 42 is, preferably, of the rare earth type such as samarium cobalt. The permanent magnet 40 has its north pole N end portion facing the north pole N of the permanent magnet 30. The core member 40 is magnetically or otherwise coupled to one end of the permanent magnet 42. Of course, this means that the induced field in the end face of the core member 40 facing the permanent magnet 42 is a south pole S, whereas the distal end 44 is a north pole N. Advantageously, as will be explained later, the magnetic polarity of the north pole N at the distal end 44 will change as a function of the spacing between it and the north pole N of the permanent magnet 30. Such a change correspondingly results in a change of the magnetic force characteristics generated by and between the first and second assemblies. The core member 40 has given magnetic characteristics. For instance, it should have relatively high permeability and be magnetically soft. The core member 40 should be easily demagnetized relative to the permanent magnets. Preferably, the permanent magnets can be magnetically hard or magnetically very hard, like samarium cobalt, while the core 40 is magnetically soft. For the reversal of polarity mentioned above to occur, the length of the core member 40 must be within a certain range. Otherwise, this change or reversal will not be attained. More particularly, if the core member 40 is either too short or too long, this polarity change will not occur. The core member 40 should be long enough so that the magnetic field of the north pole N of the permanent magnet 42 can travel longitudinally through or at least to the distal end 44. However, the core member 40 should not be so long that the distal end 44 has a magnetic field not induced by the permanent magnet 42. In regard to the latter criteria, the core member 40 should be of a given permeability and length so as to allow the magnetic field of the permanent magnet 42 to extend at least to the distal end 44, thereby making this end a north pole N. It will be appreciated, of course, that the length of the core member 40 can vary. The core member 40 should also be of adequate length so that when the distal end 44 is in close proximity to the north pole N of the permanent magnet 30 the magnetic field of the north pole N of the permanent magnet 42, which travels through the core member 40, is allowed to travel out the sides of the core. Because the north magnetic field of the permanent magnet 42 can travel out the longitudinal sides of the core 40, the distal end face 44 is allowed to be influenced by the north magnetic field of the permanent magnet 30. More particularly, the distal end 44, when in close proximity to the permanent magnet 30, can in effect have an induced south magnetic pole S (FIG. 2). Because of the capability of having the distal end face 44 reverse its magnetic polarity, the magnetic attractive and repulsive forces between the first and second assemblies can be correspondingly reversed. This reversal is a function of the distance between the magnet 30 and the distal end 44. The significance of this relative spacing will be discussed in connection with the operation of the switching mechanism 10. Further, it should also be pointed out that when the distal end 44 and the permanent magnet 30 are at a preselected distance apart the distal end 44 will exhibit neither a tendency to behave as a north pole nor a south pole. Accordingly, there will be neither attractive nor repulsive forces between the magnet 30 and the core member 40. Thus, the magnetic forces have been neutralized.

Figure 3:
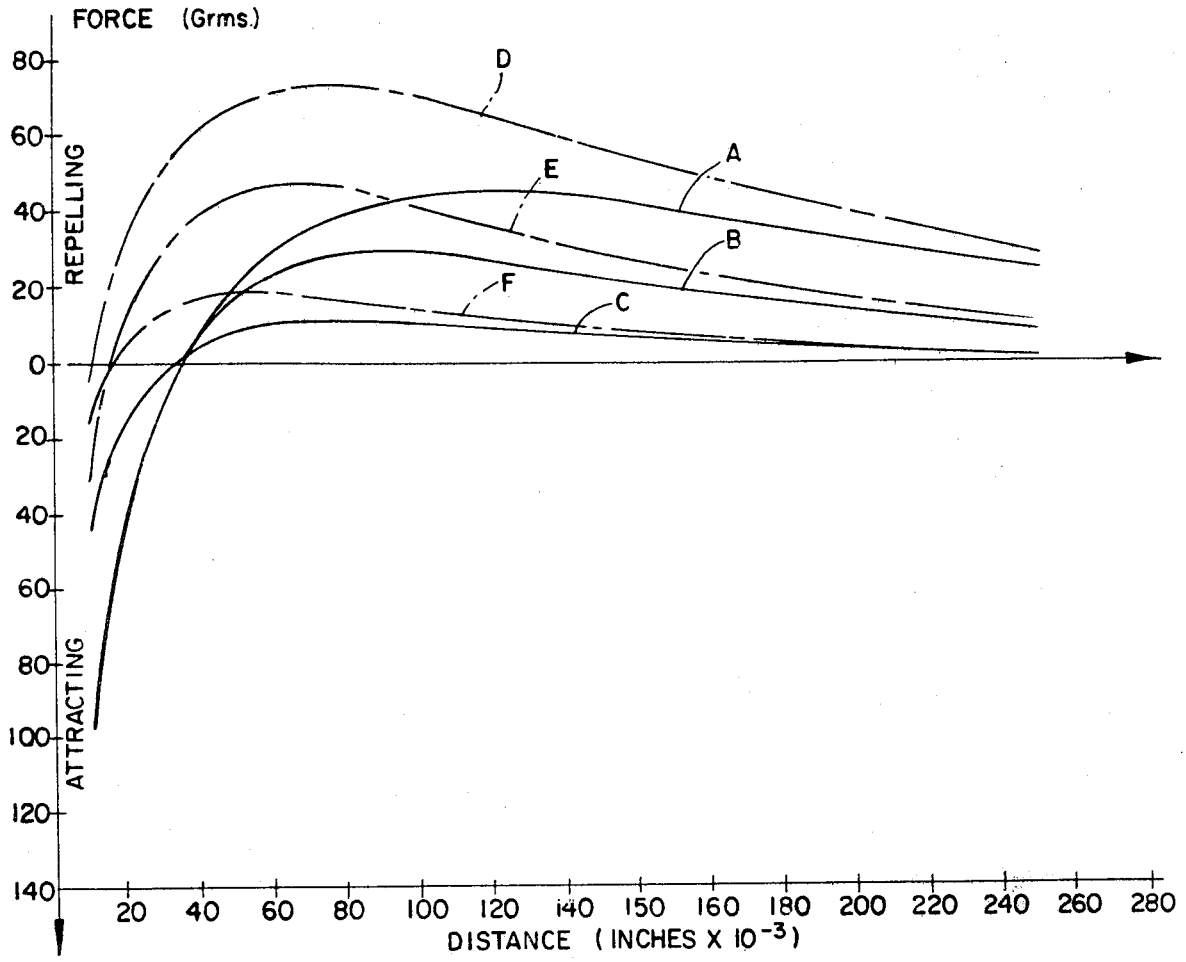
FIG. 3 is a graph depicting changing magnetic force characteristics achievable by the present invention; and, FIG. 4 is a schematic illustrating another embodiment of this invention.

To facilitate a greater understanding of the polarity changes of the kind noted above reference is made to FIG. 3. There are depicted a series of curves showing the changes and reversal of magnetic forces existing between the distal end 44 and the north pole N of the permanent magnet 30 as a function of varying the distance therebetween. Curve A, for instance, represents a given set of permanent magnets 30, 42, and core member 40 all having the same cross-sectional area. Likewise, the curves B and C represent different sets of permanent magnets and core wherein each set has a respectively different cross-sectional area. The characteristics of the curves A, B, C have been obtained with the core length being the same. Similarly, each of the curves D, E, F is representative of different sets of permanent magnets and core having respective different cross-sectional areas. Curves D, E, F represent sets of magnets and cross-sectional areas having the same areas, respectively, as the magnetic sets represented by the curves A, B, C. Although the cross-sectional areas are the same, the core length of the core in each set represented by the curves D, E, F is different than the core length used for the core in the sets represented by the curves A, B, C.

For purposes of illustration and not limitation the curves A and D are representative of a cross-sectional area of about 0.120 square inches; the curves B and E are representative of a cross-sectional area of about 0.050 square inches; while the curves C and F are representative of a cross-sectional area of about 0.025 square inches. The cores in the A, B, C group have a length of about 0.100 inches, while the cores in the D, E, F group have a length of about 0.050 inches. Because of the small size of the magnets 30, 42 and the relatively high forces generated therebetween the switching mechanism 10 can be miniature, but with relatively high forces.

As can be observed, when the permanent magnet 30 is moved relatively towards the distal end face 44 from the position shown in FIG. 1 to the position shown in FIG. 2, the repulsive force progressively increases until a maximum value is reached. Then, as the distal end face 44 draws still closer to the permanent magnet 30, the repulsive force begins to decrease progressively. When the distal end 44 is a preselected distance apart from the north pole N of the permanent magnet 30, the magnetic forces (e.g, attractive or repulsive) are at a zero value. This is so even though the distal end 44 is under the influence of the same north poles of the permanent magnets 30, 42, which are facing each other. Continued movement of the first assembly 29 toward the second assembly 34, however, results in an attractive force being generated by and between the assemblies. As will be observed from FIG. 3, the attractive forces increase progressively as the distal end 44 approaches the north pole N of the permanent magnet 30. The cross-over between attractive and repulsive forces (i.e., when the magnetic forces are zero) for the curves A, B, C is essentially the same despite the variance in cross-sectional areas. Thus, the cross-over will occur when the distal end face 44 is spaced by a predetermined distance from the north pole N of the permanent magnet 30. It should be noted that the magnetic field strength of both magnets should be essentially the same so as to attain this constant cross-over point regardless of cross-sectional area. For the group of curves D, E, F, it will be noted that the cross-over points for them are generally the same despite changes in cross-sectional area. The main reason for the change in the cross-over points for the curves A, B, C as compared to the curves D, E, F is the core length. Since the curves A, B, C have a longer core, it will be noted that the cross-over occurs when the distal end 44 is further from the north pole of the permanent magnet. Thus, the cross-over point changes as a function of core length in the manner indicated above assuming generally equal field strengths.

After describing the components and construction of the switching mechanism, its operation will be set forth in the following manner. When the left push button 27 is pushed inwardly (FIG. 1) under a suitable driving force, developed by any suitable means, the left bus bar 28 breaks the electrical circuit between the leads **22*a*, 22*b* and opens that switch. Simultaneously, of course, the carrier 26 with its permanent magnet 30 is displaced rightwardly against the repelling force between the distal end 44 and the north pole N of the permanent magnet 30. Of course, this repelling force must be overcome, if continued rightward motion is to occur. Significantly, however, continued rightward displacement causes the magnetic polarity of the distal end 44 to change. At a preselected distance apart (cross-over point), the end portion 44 acts as neither a north pole N nor a south pole S. Stated somewhat differently, there is an absence of a magnetically attractive or repulsive force between the end portion 44 and the north pole N end of the permanent magnet 30. However, as the carrier 26 continues its rightward movement beyond this preselected spaced apart distance, an attractive force is generated by and between the end portion 44 and the north pole N of the permanent magnet 30. This phenomenon is brought about because the end portion 44 is now a south magnetic pole S. This south pole S has been induced by the north pole N of the permanent magnet 30. Thus, the noted repelling force will become an attractive force which increases in magnitude as the spacing decreases. Thus, the rightward propelling forces increase until the carrier 26 reaches the position shown in FIG. 2. This results in a more rapid movement of the carrier 26. The carrier 26 will remain in the equilibrium position shown in FIG. 2 after the rightward driving force on the button 27 is relieved due to the noted attractive force. Of course, during the above the right bus bar 28 makes contact with the electrical leads 24*a*, 24*b*** and closes the switch. Thus, a highly effective yet simple switching mechanism is provided.

To electrically reconnect the left bus bar 28 with the leads **22*a*, 22*b*, the right push button 27 is driven leftwardly from the position shown in FIG. 2. Rightward movement will break the switch connection between the leads 24*a*, 24*b*. Also, this movement will be opposed by the attracting magnetic force existing by and between the commonly facing distal end 44, having a south pole, and the north pole N of the permanent magnet 30. Such opposition, because of attraction, continues until these commonly facing end portions are at the preselected cross-over distance apart; whereupon the attracting force will cease. Continued movement creates a repelling force. The repelling force comes into effect when the magnetic polarization of the distal end portion 44 reverses from a south pole S to a north pole N. As a consequence, the leftward driving force can be augmented or can be replaced by this repelling force. This repelling force increases in intensity as the distance between the distal end 44 and the north pole increases to a certain distance. This repelling force is adequate to continue such leftward movement until the bus bar 28 reconnects the leads 22*a*, 22*b*. Also, the repelling forces continue to maintain the switching arrangement 10 in the equilibrium condition shown in FIG. 1**.

It is apparent that there is a reversal in magnetic forces established by and between the end portion 44 and the north pole N end portion of the permanent magnet 30 as a function of the spacing between these commonly facing end portions. Although the previous embodiment has shown the permanent magnets having the north poles facing each other, it will be appreciated that the south poles could also face each other with the switching mechanism operating in the same manner.

Although the foregoing description is in connection with the switching mechanism 10, it should be pointed out that the principles of the present invention envisage use in other kinds of apparatus.

Figure 4:
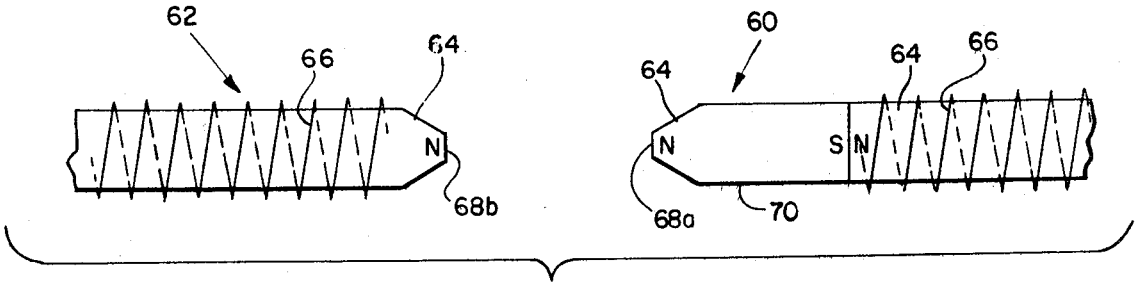

Reference is now made to FIG. 4 to show another embodiment of the present invention. In this embodiment, the reversal in magnet forces is obtained by and between electromagnets 60 and 62. As the permanent magnets 30 and 42, these electromagnets 60 and 62 serve as means for producing magnetic fields having like poles facing each other. Also, the fields are spaced apart and in general alignment along a given longitudinal direction. The electromagnets 60 and 62 each include a central ferromagnetic core 64 surrounded by windings 66. The windings 66 are connected to suitable sources of power (not shown). The electromagnets 60 and 62 have commonly facing end faces 68*a*, 68*b*; respectively. When the electromagnets 60 and 62 are energized, their end faces 68*a*, 68*b* have like poles facing each other. In this embodiment, the north poles N face each other. The end face 68*a* is on a core member 70 which extends from the core 64. In this embodiment the core 70 is made of material different than the core 64 and having similar magnetic characteristics as the core 40. Thus, the extended core portion 70 serves in a manner similar to the core 40. Towards this end, the core 70 has a high coercive force factor and high permeability. This extended portion 70 will allow the end face 68*a* to change its magnetic polarity as a function of the spacing between the end faces 68*a*, 68*b*. This spacing is, of course, varied in the same manner as the magnets 30, 42. Accordingly, the reversals in magnetic forces will follow as they did in the prior embodiment. In this embodiment, it is preferred that the magnetic field strength developed by the electromagnets 60 and 62 be generally the same.

Moreover, the present invention envisions that the means for producing magnetic fields need not be formed by pairs of rare earth magnets or electromagnets. Other kinds of magnets are usable. Also, the present invention envisions that the means for producing magnetic fields can be arranged such that one of an opposing pair is an electromagnet and the other a permanent magnet.

Since certain changes may be made in the above-described method and apparatus without departing from the scope of the invention herein involved, it is intended that all matter contained in the description or shown in the accompanying drawings shall be interpreted as illustrative and not in a limiting sense.

What is claimed is:

1. A magnetic apparatus comprising:

first and second means aligned in and spaced apart along a given direction and being operable for establishing first and second magnetic fields having predetermined strengths with like poles facing each other along said given direction;

and said first means including magnetically permeable material having a distal end face in facing relation to an opposed end face of said second means, said material having a given permeability and relatively easily demagnetizable relative to said fields and being of short enough length which, when said second means is in remote proximity to said material, will permit the magnetic field of said first means to extend at least to said distal end face of said material and of great enough length which, when said second means is in close proximity to said material, will permit substantially all of the magnetic field of said first means to pass through side surfaces of said material whereby as the distance along said given direction between said first and second means is varied, an attractive force exists between said second means and said material when said end face of said second means is within a given distance of said distal end of said material and a repulsive force exists when said end face of said second means is greater than said given distance.

2. The apparatus of claim 1 wherein neither attractive nor repulsive forces exist between said distal end face and said end face of said second means when they are spaced apart by said given distance.

3. The apparatus of claim 1 wherein said given distance can be varied as a function of the length of the permeable material along said given direction.

4. The apparatus of claim 1 wherein at least said first means includes a conductive member wrapped around a magnetically permeable core which is aligned in said given direction.

5. The apparatus of claim 4 wherein said core extends from said conductive member a given distance toward said second means such that an end portion of said core serves as said magnetically permeable material.

6. The apparatus of claim 1 wherein said first and second means include respectively a permanent magnet of the rare earth type.

7. A magnetic over-center mechanism comprising:

a pair of permanent magnetic assemblies aligned in and spaced apart along a given direction, each of said assemblies having permanent magnets, said magnets having the same polarity facing each other in said given direction; and magnetically permeable material positioned between said pair of magnets and having a distal end face thereof in facing relation to an opposed end face of one of said pair of magnets, said material having a given permeability and less resistance to demagnetization than said fields and being of short enough length which, when coupled to the end face of said one magnet and the other of said magnets is in remote proximity to said distal end face material the magnetic field of said one magnet is permitted to extend at least to the distal end face of said material and said material being of great enough length, when the other of said magnets is in close proximity to said distal end face, the magnetic field of said one magnet will permit substantially all of its field to pass through side surfaces of said material whereby as the distance along said given direction between said magnets is varied, an attractive force exists between said other magnet and said material when said end face of said other magnet is within a given distance of said distal end of said material and a repulsive force exists when said end face of said other magnet is greater than said given distance.

8. The mechanism of claim 7 further including switching means being operatively connected to said pair of magnetic assemblies and being operable to be in one condition when said distal end and said end face of said other magnet are spaced greater than said given distance, and when said distal end and said end face of said other magnet are spaced less than said given distance said switching means is in another condition.

9. A method of changing magnetic forces comprising the steps of:

establishing first and second magnetic fields having predetermined strengths with like poles facing each other in alignment and spaced apart along a given direction;

having magnetically permeable material associated with the first field and having a distal end face in facing relation to a like pole of the second field, wherein the material has a given permeability and less resistance to demagnetization than said fields and is of short enough length so that, when the second pole is in remote proximity to the distal end of the material the magnetic field of the like pole of the first field is permitted to extend at least to the distal end face of the material and the material is of great enough length so that when the facing pole of the second field is in close proximity to the distal end substantially all of the magnetic field of the like pole of the first field is permitted to pass through side surfaces of the material; and varying the distance along the given direction between the first and second facing poles so that an attractive force exists between the second pole and the distal end of the material when the like pole of the second field is within a given distance of the distal end of the material and a repulsive force exists when the like pole of the second field is greater than said given distance.

10. The method of claim 9 comprising the step of substantially eliminating repulsive or attractive forces between the distal end and the facing pole of the second field.

11. The method of claim 9 wherein said given distance can be varied by varying the length of the permeable material along the given direction.

12. The method of claim 9 wherein said first and second fields are produced respectively by first and second permanent magnets of the rare earth type.

* * * * *